US007225509B2

(12) United States Patent
Bernasconi

(10) Patent No.: US 7,225,509 B2
(45) Date of Patent: Jun. 5, 2007

(54) SLIDER FOR ZIP FASTENER WITH TWO TABS AND A SINGLE FORK FOR RELEASING THE SLIDER

(75) Inventor: Sergio Bernasconi, Mendrisio (CH)

(73) Assignee: Crelux Holding SA, Mendisio (CH)

( * ) Notice: Subject to any disclaimer, the term of this patent is extended or adjusted under 35 U.S.C. 154(b) by 0 days.

(21) Appl. No.: 11/327,309

(22) Filed: Jan. 9, 2006

(65) Prior Publication Data

US 2006/0112524 A1 Jun. 1, 2006

Related U.S. Application Data

(62) Division of application No. 10/757,423, filed on Jan. 15, 2004, now Pat. No. 7,017,242.

(30) Foreign Application Priority Data

Oct. 28, 2003 (CH) ..... 1839/03

(51) Int. Cl.
*A44B 19/30* (2006.01)

(52) U.S. Cl. ..... 24/422

(58) Field of Classification Search ..... 24/415–426

See application file for complete search history.

(56) References Cited

U.S. PATENT DOCUMENTS

| | | | | |
|---|---|---|---|---|
| 2,349,580 | A * | 5/1944 | Marinsky et al. | 24/422 |
| 2,405,875 | A * | 8/1946 | Carlile | 24/422 |
| 2,405,883 | A * | 8/1946 | Gould | 24/422 |
| 2,423,210 | A | 7/1947 | Ulridh et al. | 24/422 |
| 2,657,444 | A | 11/1953 | Bashover | 24/422 |
| 2,839,806 | A * | 6/1958 | Moser | 24/424 |
| 2,953,831 | A | 9/1960 | Morin | 24/422 |
| 3,006,050 | A | 10/1961 | Brown | 24/422 |
| 3,038,227 | A * | 6/1962 | Godfrey et al. | 24/422 |
| 3,129,480 | A | 4/1964 | Carlile | 24/422 |

* cited by examiner

*Primary Examiner*—Robert J. Sandy
*Assistant Examiner*—Ruth C. Rodriguez
(74) *Attorney, Agent, or Firm*—Young & Thompson

(57) ABSTRACT

A slider for zip fasteners with two tabs, includes a hollow body in which are positioned members designed in such a way that, when either one of the two tabs is pulled, this causes the disengagement of a pawl from the teeth of a fastener, overcoming the resistance of elastic elements which keep the pawl inserted between the teeth. In the slider, the members include a fork provided with two prongs positioned on opposite sides of the plane of the teeth and pivoted at a point of the slider in such a way that it can rotate in a plane perpendicular to the plane of the teeth when a force is exerted on at least one of its prongs by the tab connected to it by its ring.

13 Claims, 6 Drawing Sheets

SLIDER FOR ZIP FASTENER WITH TWO TABS AND A SINGLE FORK FOR RELEASING THE SLIDER

This application is a division of application Ser. No. 10/757,423, filed on Jan. 15, 2004 now U.S. Pat. No. 7,017,242, the entire contents of which are hereby incorporated by reference.

FIELD OF THE INVENTION

The present invention relates to the field of what are called "zip fasteners", in other words fasteners which can be opened and closed by pulling on either one of two tabs connected on opposite sides, by means of their rings, to a slider, in other words to the member which joins and disengages the teeth of the fastener.

BACKGROUND OF THE INVENTION

An example of such a slider is described in the patent EP 204 186 B1 held by YKK, and another example is illustrated in Swiss patent application 01697/03 filed by the present applicant.

In both of the examples, the slider is locked in its position by means of a pointed member which penetrates between the teeth of the fastener, and in order to move the slider it is first necessary to disengage this member, which can also be called a "pawl", from the teeth.

To ensure that this locking operation can be performed by pulling as stated on either one of the two tabs connected to the slider, the terminal rings of the tabs are connected to two levers, located inside the hollow body of the slider on opposite sides of the plane of the fastener, and interconnected by contact or by means of suitable return members. One of these levers is connected integrally to the aforesaid pawl, and the levers are designed and positioned in such a way that a pull on either one of the two tabs will directly or indirectly cause the movement of the pawl in such a way as to disengage it from the teeth of the fastener.

The manufacture of the levers described above and of the corresponding actuating systems entails production and assembly costs which, given the intrinsically relatively low value of a slider with two tabs, have a significant effect on the final cost.

Moreover, since an increase in the number of parts of an assembly also increases the potential causes of malfunction, the reliability of sliders made as described above can some times be inadequate, and in order to achieve correct operation it is necessary to use more costly methods and materials, which in turn have an additional effect on the price.

SUMMARY OF THE INVENTION

The inventor of the slider with two tabs according to the present invention has devised a solution in which the aforementioned two levers form a single piece, and more specifically a single fork whose two prongs perform the function of the two levers. This fork, connected by means of the aforesaid prongs to one of the sliders and to the pawl described previously, is pivoted within the hollow body of the slider, and is shaped and positioned in such a way that, by pulling as stated on either one of the two tabs, the user can act on the pawl in such a way that it is disengaged from the teeth of the fastener so that the slider can be moved.

Like all sliders with two tabs, the slider according to the invention, as described below, comprises elastic means for keeping the pawl inserted between the teeth of a fastener until, when the prongs are acted on, these means are deformed elastically to a sufficient degree to disengage the pawl.

The object of the present invention is therefore a slider for fasteners with two tabs as described in the attached Claim 1.

BRIEF DESCRIPTION OF THE DRAWINGS

Two examples of embodiment of the slider according to the invention will now be described, with additional reference to the attached drawings, in which.

DETAILED DESCRIPTION OF THE INVENTION

Figure 1:
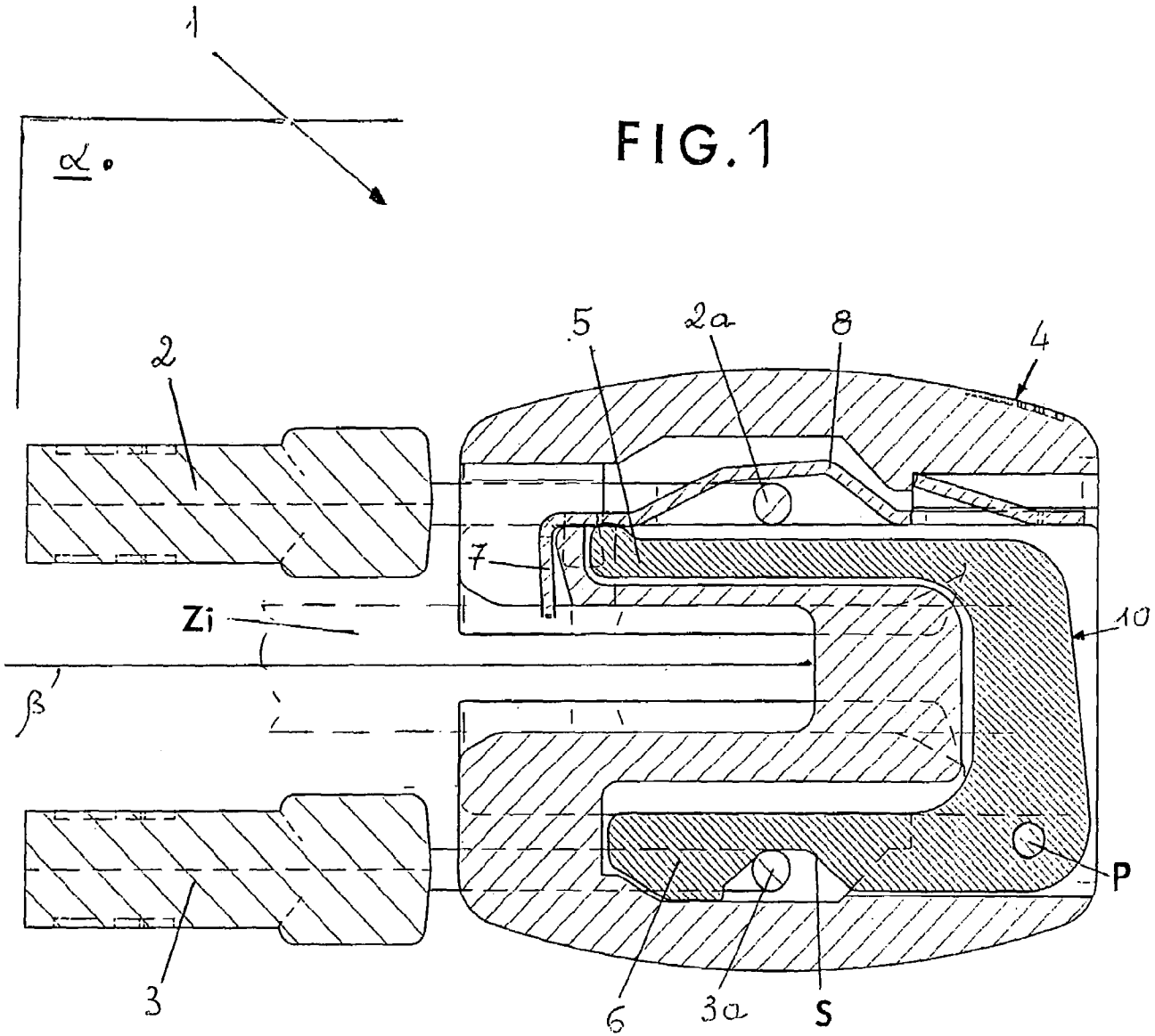
FIG. 1 is an enlarged longitudinal section through a first example of embodiment of the slider according to the invention, in which the pawl does not form part of the fork, and is provided with an elastically flexible portion which keeps it inserted between the teeth of a fastener.
Figure 2:
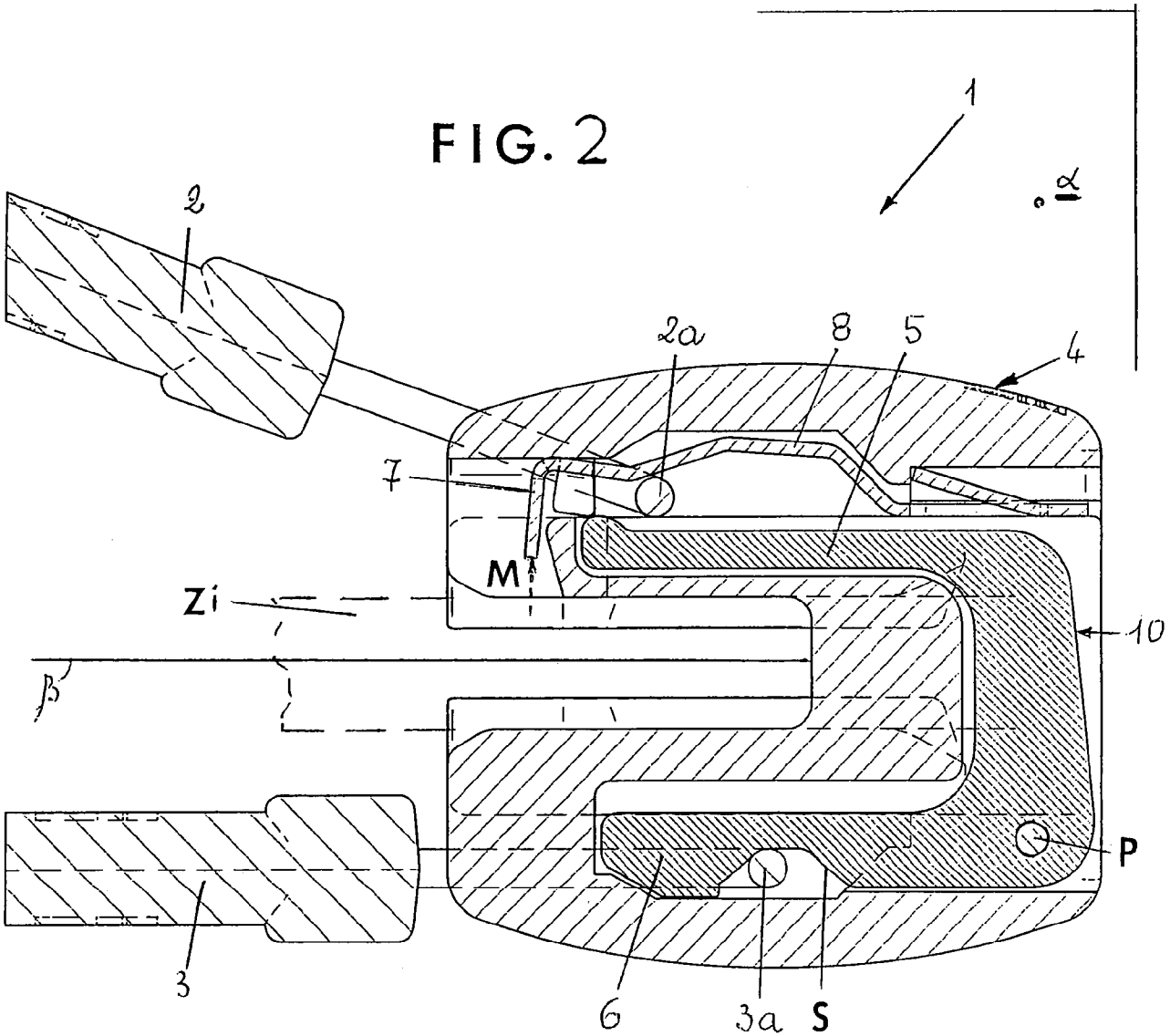
FIG. 2 is the same longitudinal section as that shown in FIG. 1, in which the fork has been made to rotate by a pull on the tab in the upper part of the drawing, in such a way that the aforesaid pawl is disengaged from the teeth of the fastener.
Figure 3:
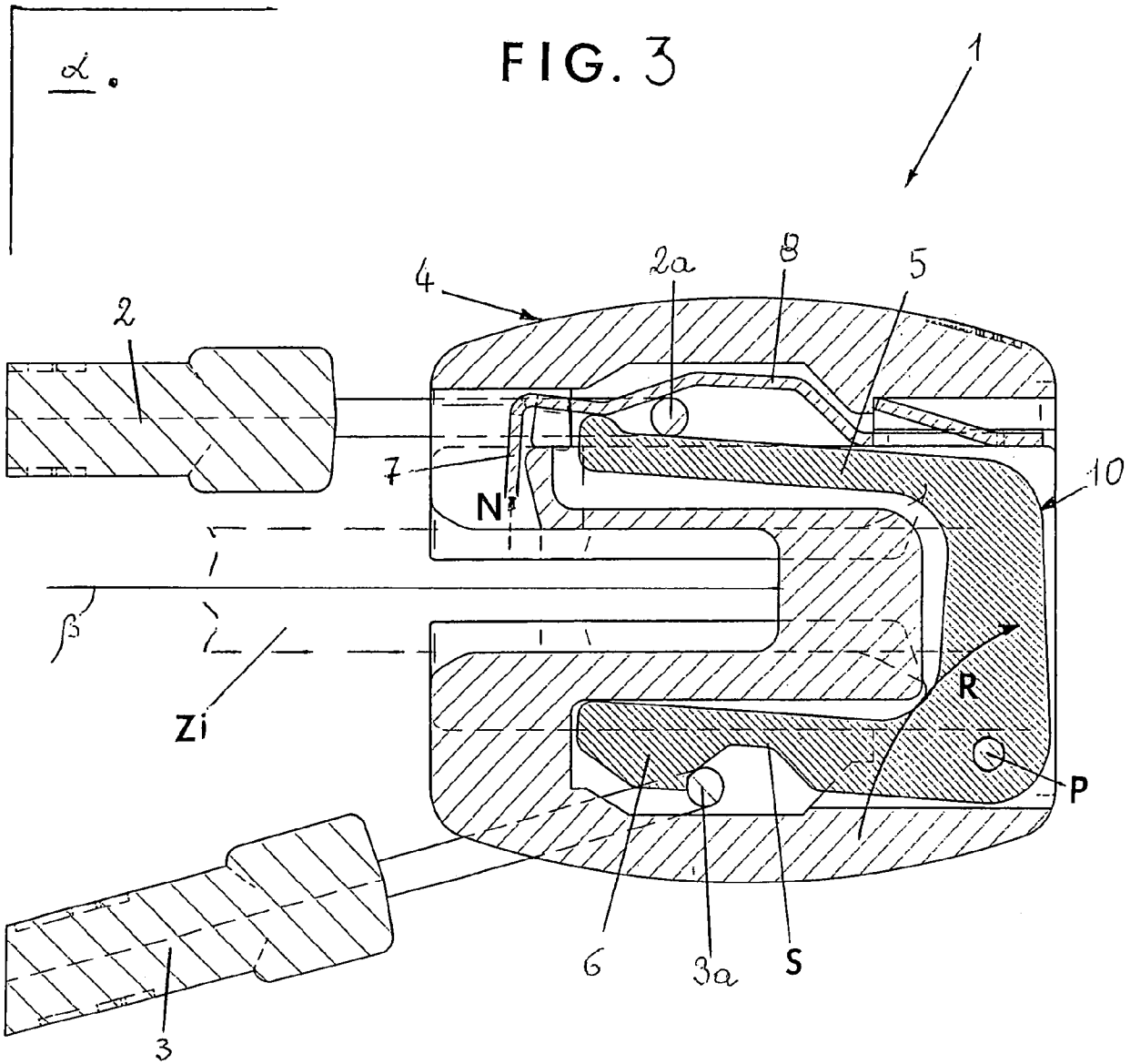
FIG. 3 is the same section as that shown in the preceding figures, in which the pawl is disengaged from the teeth of the fastener by a pull on the tab in the lower part of the drawing.

With reference initially to FIGS. 1, 2, 3, these show how, in a slider 1 with two tabs 2 and 3 according to the invention, its hollow body 4 houses within it a fork 10, pivoted at a point P of the slider and consisting of two prongs 5 and 6 positioned on opposite sides of the plane β occupied by the teeth Zi of a fastener (not all of which is shown). A flexibly elastic strip 8 terminates in a pawl 7, and the strip 8 is shaped in such a way that, when no force is applied to it, its pawl 7 is kept inserted between the teeth Zi to keep the slider 1 locked. The strip 8 is positioned so that it faces and is parallel to one prong 5 of the fork 10.

The tab 2 in the upper part of the drawing is connected by its ring 2*a* to the strip 8 in such a way that pulling the tab (see FIG. 2) causes the pawl 7 to be disengaged from the teeth Zi (arrow M).

The tab 3 in the lower part of the drawing is connected by its ring 3*a* to the prong 6 in the lower part of the drawing, and pulling this tab causes a rotation (arrow R in FIG. 3) of the fork 10 about the point P, in a plane a perpendicular to the plane β of the teeth Zi, which makes the prong 5 in the upper part of the drawing, which is in contact with the strip 8, cause an elastic deformation of the strip in this case also, thus disengaging the pawl 7 from the teeth Zi (arrow N).

It should be noted that, whereas the tab 2 in the upper part of the drawing acts directly by traction on the strip 8, the tab 3 in the lower part of the drawing acts on the prong 6 by pressing with its ring 3*a* on a surface with inclined planes S in such a way as to cause the rotation R of the fork 10.

This system of connection by means of inclined planes is known to those skilled in the art.

Figure 4:
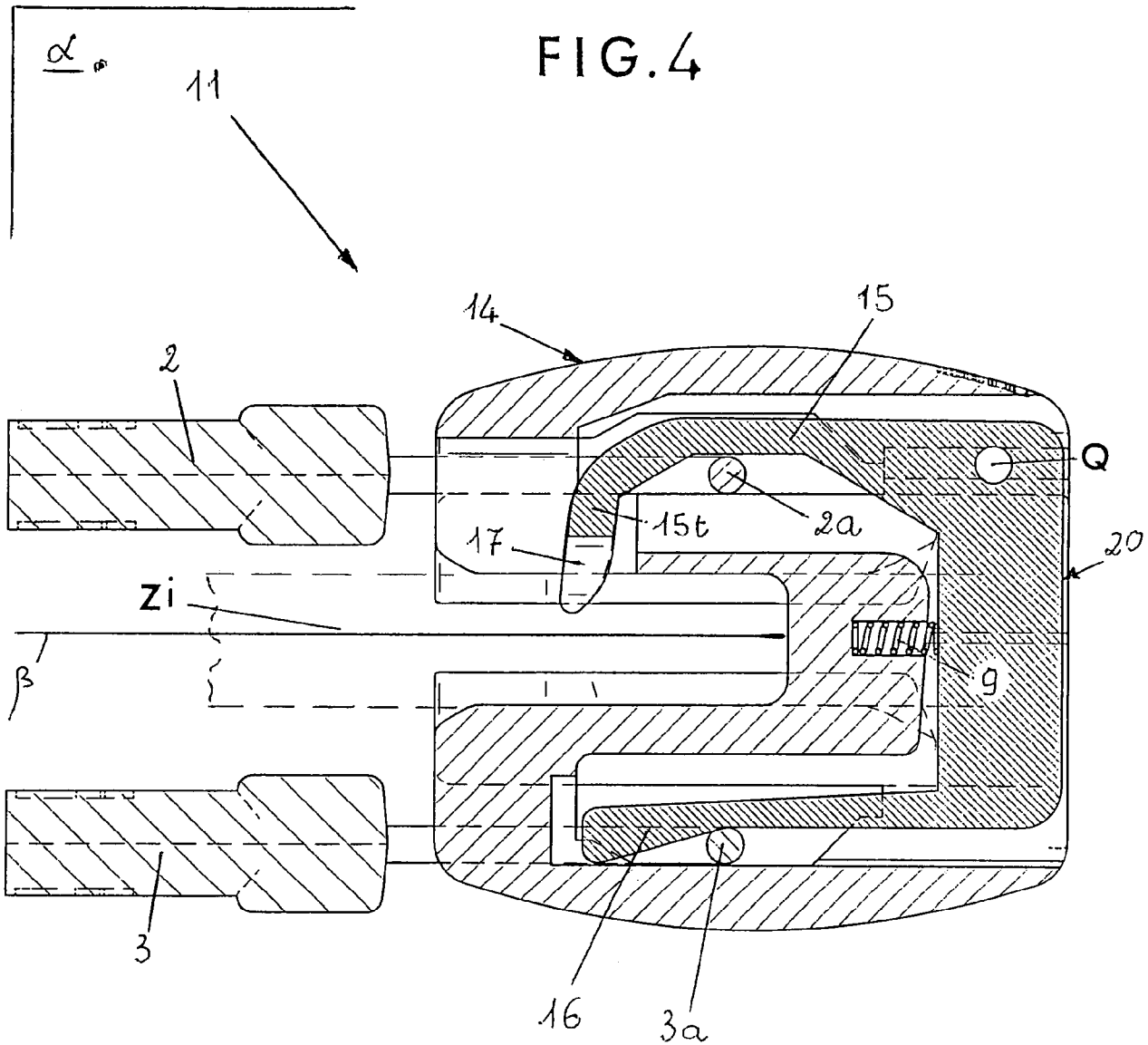
FIG. 4 is the enlarged longitudinal section through a second example of embodiment, in which the pawl is formed integrally on the terminal part of one of the prongs of the fork, and the elastic means for returning the pawl to the position in which it locks the slider consist of a spring interposed between the fork and the hollow body of the slider.

FIG. 4 shows another example of embodiment 11 of the slider according to the invention. In this case also, the slider 11 has a hollow body 14 in which is housed a fork 20 with two prongs 15 and 16, pivoted at a point Q in such a way that it can rotate (arrow O, FIGS. 5 and 6) in a plane α perpendicular to the plane β of the teeth Zi of the fastener (again not all of which is shown).

In this case, however, the pawl 7 does not form part of a separate member, but is formed integrally on the free end 15*t* of a prong 15, which is drawn in the upper part of the figure.

Figure 5:
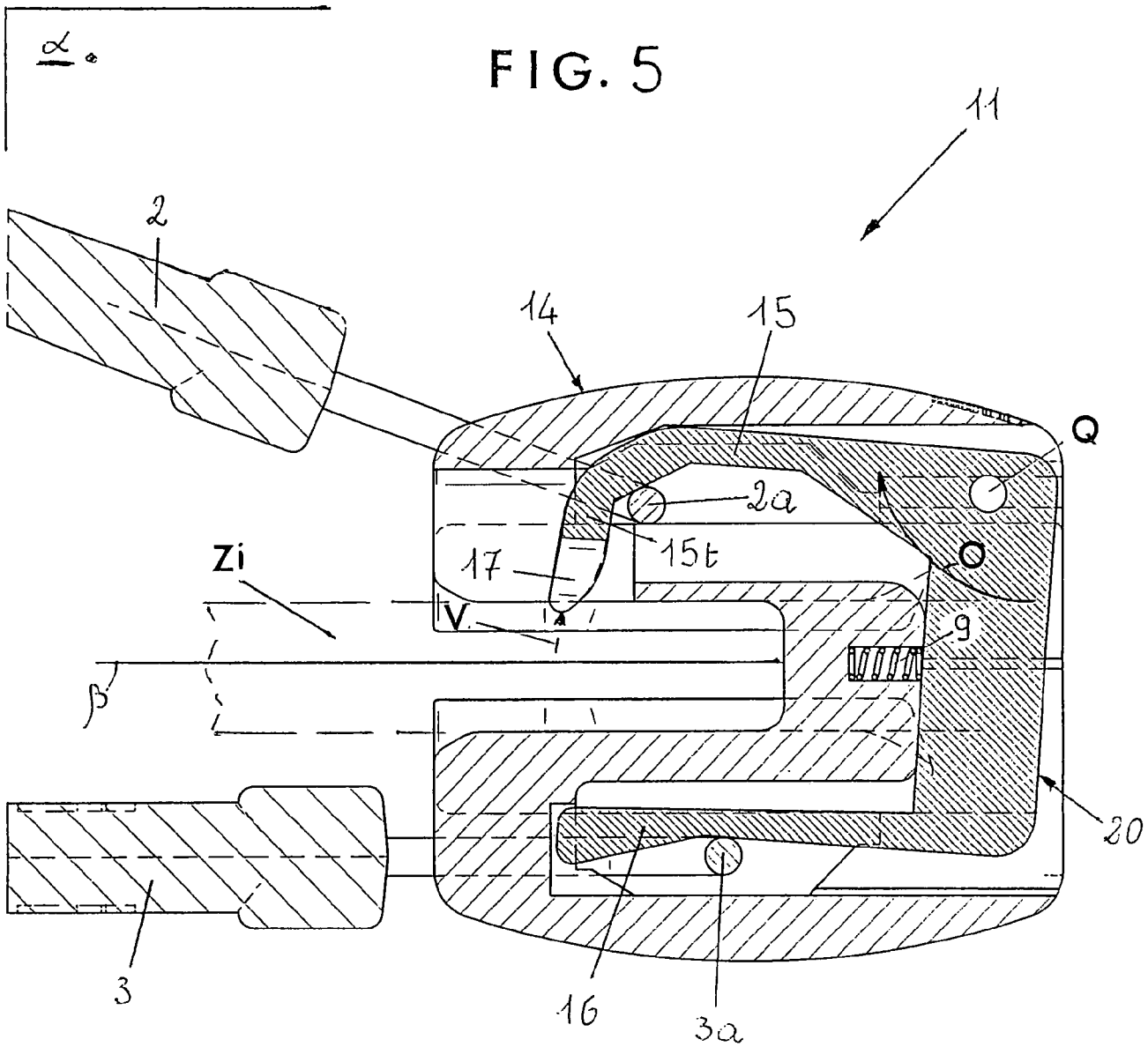
FIG. 5 is the same longitudinal section as that shown in FIG. 4, in which the prong bearing the pawl has been made to rotate, thus disengaging the pawl, by means of the tab in the upper part of the drawing.
Figure 6:
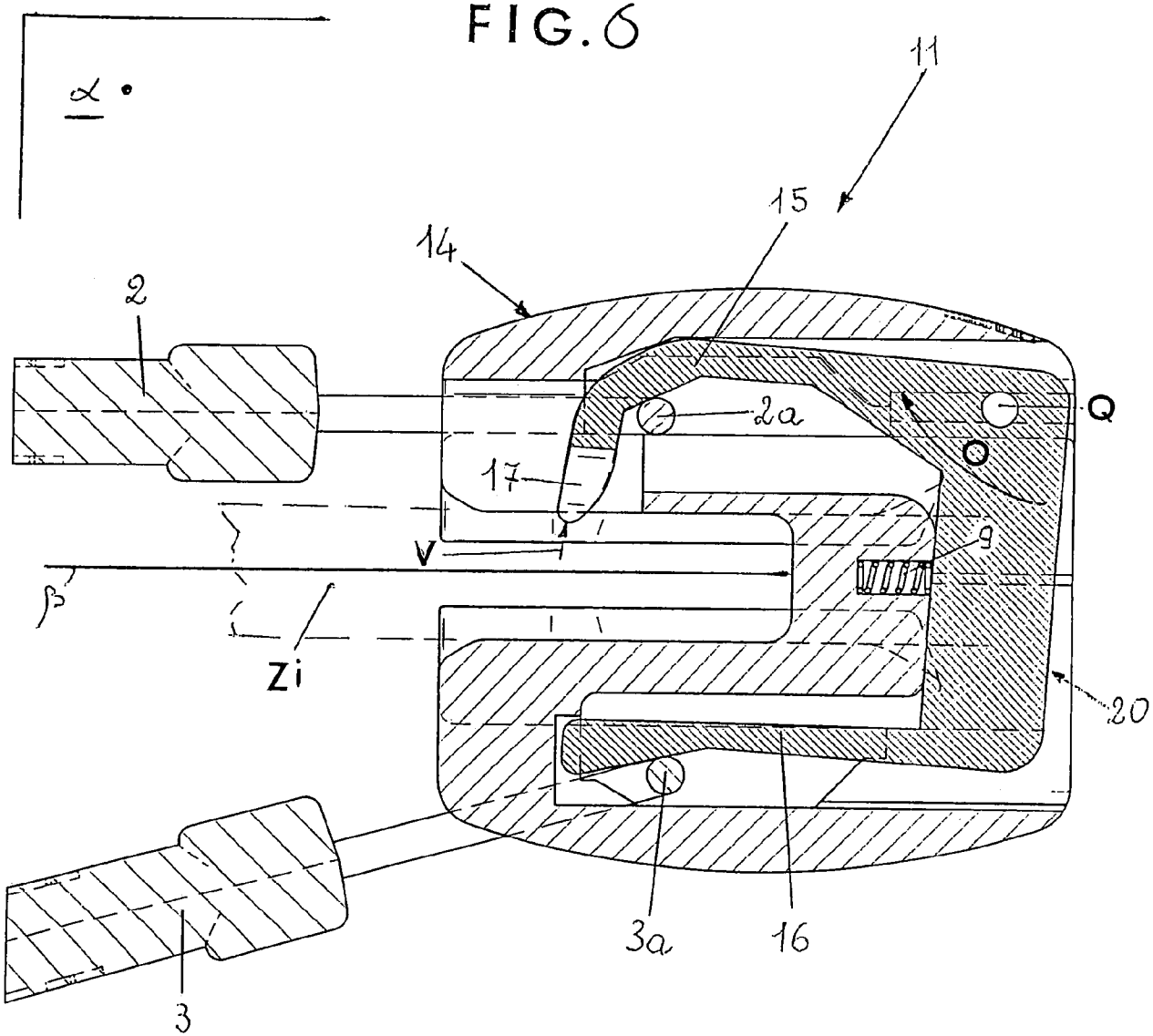
FIG. 6 is the section shown in FIG. 5, in which the prong bearing the pawl has been made to rotate by a pull on the other prong of the fork by means of the tab in the lower part of the drawing.

As shown in FIGS. 5 and 6, pulling on either one of the two tabs 2 and 3 connected by their rings 2*a* and 3*a* to the two prongs 15 and 16 makes the fork 20 rotate in the direction of the arrow O, thus extracting (arrow V) the aforesaid pawl 17 from the teeth Zi of the fastener.

In this case, the elastic force which keeps the pawl 17 inserted between the teeth Zi is provided by a spring 9 interposed between the fork 20 and the hollow body 4 of the slider 11, the spring being positioned and designed in such a way as to oppose the rotation 0 of the fork 20.

In both embodiments described above, a slider 1, 11 according to the invention is provided, this slider consisting of a smaller number of components and being consequently more reliable and less expensive to produce.

The invention claimed is:

1. Slider for zip fasteners with two tabs, comprising a hollow body in which hollow body are positioned means designed in such a way that, when either one of said two tabs is pulled, this causes the disengagement of a pawl from the teeth of a fastener, overcoming the resistance of elastic means which keep the pawl inserted between said teeth, wherein said means comprise a fork provided with two prongs positioned on opposite sides of a first plane of said teeth and pivoted at a point of the slider in such a way that said fork can rotate in a second plane perpendicular to said first plane of the teeth when a force is exerted on at least one of its prongs by the tab connected thereto by its ring, and said pawl being formed on the free end of one of the prongs, an elastically compressible spring being inserted between said fork and the hollow body of the slider, said spring keeping the pawl inserted between the teeth of the fastener when no force is applied to the fork, each of said prongs being connected to one of the two tabs by the corresponding ring in such a way that, when either one of the two tabs is pulled, the fork is made to rotate in such a way so as to cause the disengagement of the pawl from the teeth of the fastener, wherein the fork is a singlepiece fork free of any joints between the two prongs, wherein, the hollow body surrounds an exterior perimeter of an entire length of the two prongs.

2. The slider of claim 1, wherein, the ring (2*a*) of a first of the tabs (2) is located within an interior of the fork inside the two prongs (15, 16) and the ring (3*a*) of a second of the tabs (3) is located exterior to the fork and outside the two prongs.

3. The slider of claim 1, wherein, an elevation of the pawl (17) formed on the free end of the one prong (15) is obtained on the whole 180 degrees rotation of the tab (3) corresponding to the other prong (16).

4. The slider of claim 1, wherein, an elevation of the pawl (17) formed on the free end of the one prong (15) is obtained on the whole 180 degrees rotation of the tab (3) corresponding to the other prong (16).

5. The slider of claim 2, wherein, an elevation of the pawl (17) formed on the free end of the one prong (15) is obtained on the whole 180 degrees rotation of the tab (3) corresponding to the other prong (16).

6. The slider of claim 1, wherein, the spring and the prongs have approximately parallel longitudinal axes.

7. Slider for zip fasteners with two tabs, comprising:

a fork comprising two prongs of approximate equal length, the fork being a singlepiece fork free of any joints between the two prongs;

a pawl located on a free end of one of the prongs;

a hollow body surrounding the two prongs along the entire length of the prongs;

a pivot point;

two tabs connecting each of said prongs to one of the two tabs;

an elastically compressible spring between the fork and the hollow body, the spring keeping the pawl inserted between the teeth of the fastener when no force is applied to the fork, the fork and body mutual arranged so that when either one of said two tabs is pulled, the pulling causes the disengagement of a pawl from the teeth of a fastener, overcoming the resistance of the spring, the fork and the two prongs being positioned on opposite sides of a first plane of said teeth and pivoted at the pivot point in such a way that said fork can rotate in a second plane perpendicular to said first plane of the teeth when a force is exerted on at least one of the prongs by the tab connected thereto by the ring, and when either one of the two tabs is pulled, the fork is made to rotate in such a way so as to cause the disengagement of the pawl from the teeth of the fastener.

8. The slider of claim 7, wherein, the spring is perpendicular to a portion of the fork joining the two prongs, the portion of the fork being generally perpendicular to the longitudinal axes of the two prongs.

9. The slider of claim 7, wherein, the ring (2*a*) of a first of the tabs (2) is located within an interior of the fork inside the two prongs (15, 16) and the ring (3*a*) of a second of the tabs (3) is located exterior to the fork and outside the two prongs.

10. The slider of claim 7, wherein, the spring and the prongs have approximately parallel longitudinal axes, and the spring is perpendicular to a portion of the fork joining the two prongs, the portion of the fork being generally perpendicular to the longitudinal axes of the two prongs.

11. A slider, comprising:

two tabs (2, 3) with rings (2*a*, 3*a*);

a fork (20) with two prongs (15, 16) joined by a portion generally perpendicular to longitudinal axes of the two prongs;

a hollow body (4) interiorly housing the fork (10);

a spring intermediate the housing and the fork, the spring and he prongs have approximately parallel longitudinal axes;

a fork pivot point (Q), the fork and the two prongs (15, 16) pivoting at the point to rotate along an arcuate line described by an arrow (O) in a plane (α) perpendicular to a plane (β) of teeth (Zi) of a fastener being acted on;

a pawl (17) formed integrally on a free end (15*t*) of a first of the two prongs (15), wherein, the two tabs are connected by the rings to the two prongs so that pulling on either one of the two tabs makes the fork rotate in a direction of the arrow (O) and thus extracting the pawl from the teeth of the fastener, wherein, the hollow body surrounds the exterior perimeter of an entire length of the two prongs.

12. The slider of claim 11, wherein, the ring (2*a*) of a first of the tabs (2) is located within an interior of the fork inside the two prongs (15, 16) and the ring (3*a*) of a second of the tabs (3) is located exterior to the fork and outside the two prongs.

13. The slider of claim 11, wherein, an elevation of the pawl (17) formed on the free end of the one prong (15) is obtained on the whole 180 degrees rotation of the tab (3) corresponding to the other prong (16).

* * * * *